US011306668B1

(12) United States Patent
Fulton et al.

(10) Patent No.: US 11,306,668 B1
(45) Date of Patent: Apr. 19, 2022

(54) METHODS AND SYSTEMS FOR ENGINE VALVE TIMING OR LIFT ADJUSTMENT

(71) Applicant: Ford Global Technologies, LLC, Dearborn, MI (US)

(72) Inventors: Brien Fulton, Bloomfield Hills, MI (US); Michiel J. Van Nieuwstadt, Ann Arbor, MI (US); Chris Glugla, Macomb, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/143,079

(22) Filed: Jan. 6, 2021

(51) Int. Cl.

| | |
|---|---|
| ***F02D 13/02*** | (2006.01) |
| ***F02D 35/02*** | (2006.01) |
| *F02D 41/00* | (2006.01) |
| *F02D 41/28* | (2006.01) |

(52) U.S. Cl.
CPC ..... *F02D 35/024* (2013.01); *F02D 13/0207* (2013.01); *F02D 35/023* (2013.01); *F01L 2800/00* (2013.01); *F01L 2800/09* (2013.01); *F01L 2800/14* (2013.01); *F02D 2041/001* (2013.01); *F02D 2041/286* (2013.01); *F02D 2200/0406* (2013.01)

(58) Field of Classification Search
CPC ..... F01L 2800/09; F01L 2800/14; F02D 13/0203–0296; F02D 35/023; F02D 35/024
USPC .... 123/90.15–90.18, 435; 73/114.16, 114.79
See application file for complete search history.

(56) References Cited

U.S. PATENT DOCUMENTS

| | | | | |
|---|---|---|---|---|
| 4,995,351 | A * | 2/1991 | Ohkubo | F02D 35/023 123/90.11 |
| 9,347,413 | B2 * | 5/2016 | Schule | F01L 13/0015 |
| 10,215,106 | B2 * | 2/2019 | Kurtz | F01L 1/344 |
| 10,563,598 | B2 * | 2/2020 | Cho | F02D 35/023 |
| 2010/0063775 | A1 * | 3/2010 | Colling | G01M 15/00 702/182 |
| 2010/0262355 | A1 * | 10/2010 | Bauer | F02D 41/221 701/103 |
| 2020/0040830 | A1 * | 2/2020 | Braun | F01L 1/34 |

OTHER PUBLICATIONS

Fulton, B. et al., "Methods and System for a Boosted Engine," U.S. Appl. No. 16/953,028, filed Nov. 19, 2020, 71 pages.

* cited by examiner

*Primary Examiner* — Erick R Solis
(74) *Attorney, Agent, or Firm* — Geoffrey Brumbaugh; McCoy Russell LLP

(57) ABSTRACT

Methods and systems are provided for controlling and monitoring intake and exhaust poppet valves of an internal combustion engine. In one example, the methods and system include feedback control that estimates intake and exhaust valve timing based on output of an in cylinder pressure sensor. In another example, the methods and system include compensation for feedforward control of intake and exhaust valves based on output of the in cylinder pressure sensor.

20 Claims, 8 Drawing Sheets

METHODS AND SYSTEMS FOR ENGINE VALVE TIMING OR LIFT ADJUSTMENT

FIELD

The present description relates generally to methods and systems for determining and adjusting intake and/or exhaust valve timing and/or lift.

BACKGROUND/SUMMARY

Engine systems may include an adjustable valve timing system to control operation of intake and exhaust valves. In one example, the adjustable valve timing system may be a cam actuation system including one or more cams. The cam actuation systems may utilize variable valve timing (VVT) and/or variable valve lift (VVL) systems to vary valve operation. Control systems for VVT and/or VVL may use one or more intake valve position sensors and one or more exhaust valve position sensors to determine intake and exhaust valve timings respectively.

The intake and exhaust valve position sensors may sense valve position directly or via a valve train component that may be linked with an engine crankshaft via timing chains, which may lead to valve position tolerance stack-up errors. Further, an error in functioning of the valve position sensors may result in an error in cylinder valve timing control, which in turn may increase emission and/or reduce engine output. As such, the valve position sensors may be monitored separately, which adds complexity to the engine controls. Furthermore, the valve position sensors add cost to the engine system and may be difficult to replace.

Therefore, in some examples, it may be desirable to generate a reliable valve position signal without using valve position sensors. Further, in systems including valve position sensors, a back-up control for a degraded valve position sensor may be desired, as well as a reliable on-board diagnostic monitoring method for a valve position sensor may be desired.

The inventors herein have recognized the above-mentioned disadvantages of valve position sensors and have developed a method for operating an engine, comprising: via a controller, estimating intake valve opening timing and estimating exhaust valve opening timing of a cylinder from output of a pressure sensor in the cylinder; adjusting a feedforward intake valve opening timing via a feedforward intake valve offset without generating an error value, the feedforward intake valve offset based on the estimated intake valve opening timing; and adjusting opening of an intake valve according to the adjusted feedforward intake valve opening timing.

By estimating intake valve opening timing and exhaust valve opening timing of a cylinder from output of a pressure sensor, it may be possible to provide the technical result of reducing valve position feedback errors. The reduction in valve position feedback errors may improve engine emissions. In particular, intake and exhaust valve opening time estimates may be based on characteristics of pressure in a cylinder so that valve timing stack-up errors that may be related to mechanical devices may not present in intake and exhaust opening timing estimates.

The approach described herein may have several advantages. In particular, the approach may reduce intake and exhaust valve feedback timing errors. Further, the approach may reduce system cost by eliminating sensors that determine intake and exhaust valve positions via mechanical motion. In addition, the approach may improve robustness of systems that do measure intake and exhaust valve positions via mechanical motion.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
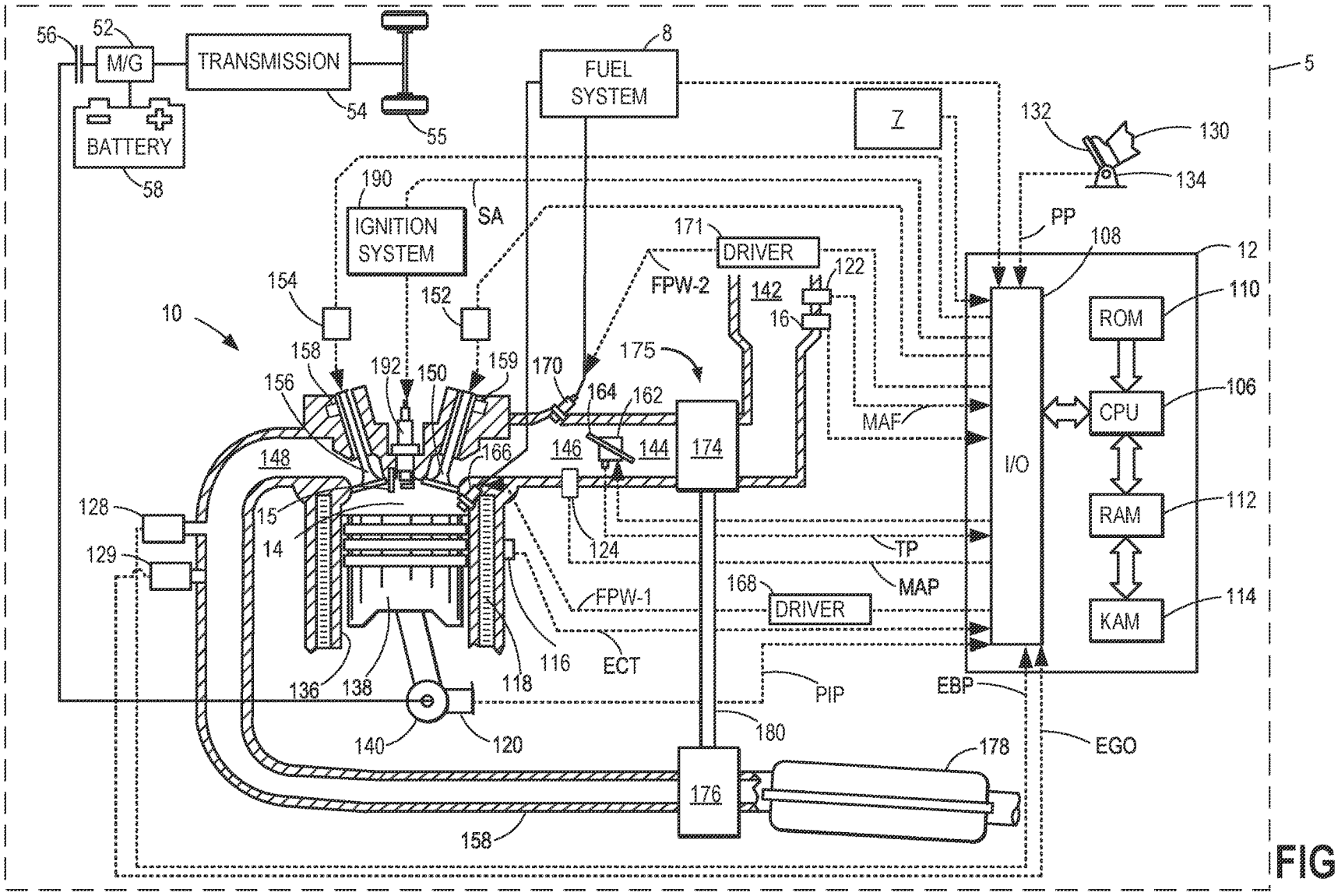
FIG. 1 shows an example embodiment of a boosted engine system.

The following description relates to systems and methods for determining and/or adjusting cylinder valve timing in an engine system such as the engine system shown at FIG. 1. A controller may be configured to perform a control routine, such as the routine of FIG. 2A, to determine intake and exhaust valve opening and closing timings from cylinder pressures. Alternatively, the controller may perform the routine shown in FIG. 2B to determine intake and exhaust valve opening and closing timings from cylinder pressures. Intake and exhaust valve opening and closing timings may be determined from characteristics of cylinder pressure as shown in FIGS. 3A and 3B. Intake and exhaust valves may be operated by applying the determined intake and exhaust valve opening and closing times according to one of the controllers shown in FIGS. 4-6.

Referring now to FIG. 1, an example of a cylinder of internal combustion engine 10 included in vehicle 5 is depicted. Engine 10 may be controlled at least partially by a control system including controller 12 and by input from a human vehicle operator 130 via an input device 132. In this example, input device 132 includes a propulsive effort pedal and a pedal position sensor 134 for generating a proportional pedal position signal PP. Cylinder 14 (which may be referred to herein as a combustion chamber) of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of vehicle 5 via a transmission system. Further, a starter motor (not shown) may be coupled to crankshaft 140 via a flywheel to enable a starting operation of engine 10. In one example, an engine speed sensor 120 may be coupled to the crankshaft 140 to provide an indication of engine speed. For example, the engine speed sensor may produce a predetermined number of equally spaced pulses every revolution of the crankshaft 140.

Cylinder 14 may receive intake air via a series of intake air passages 142, 144, and 146. Intake air passage 146 may communicate with other cylinders of engine 10 in addition to cylinder 14. FIG. 1 shows engine 10 configured with a turbocharger 175 including a compressor 174 arranged between intake passages 142 and 144, and an exhaust turbine 176 arranged along an exhaust passage 148. Compressor 174 may be at least partially powered by exhaust turbine 176 via a shaft 180. An electrically controlled throttle 162 including a throttle plate 164 may be provided along an intake passage of the engine for varying a flow rate and/or pressure of intake air provided to the engine cylinders. For example, throttle 162 may be positioned downstream of compressor 174 as shown in FIG. 1, or alternatively may be provided upstream of compressor 174.

Exhaust passage 148 can receive exhaust gases from other cylinders of engine 10 in addition to cylinder 14. Upstream sensors 128 and 129 are shown coupled to exhaust passage 148 upstream of an underbody emissions treatment device 178. Upstream sensor 128 may be an exhaust back pressure (EBP) sensor, for measuring an exhaust gas pressure in the exhaust passage 148 upstream of inlet to the turbine 176. Upstream sensor 129 may be selected from among various suitable sensors for providing an indication of exhaust gas air-fuel ratio such as a linear oxygen sensor or UEGO (universal or wide-range exhaust gas oxygen), a two-state oxygen sensor or EGO (as depicted), a HEGO (heated EGO), an HC, CO, or NOx sensor, for example.

Herein, when referring to components (e.g., sensors, emission treatment devices, etc.) disposed in the exhaust passage 148, "upstream" may refer to a position of one component being closer to the engine 10 than a position of another component; similarly, "downstream" may refer to a position of one component being farther from the engine 10 than a position of another component.

Underbody emissions treatment device 178 may be a three way catalyst (TWC), HC trap, NOx trap, GPF, DOC, DPF, SCR, LNT or other various other emissions treatment devices, or combinations thereof. In one example, the underbody emissions treatment device 178 is arranged in a far vehicle underbody.

Each cylinder 14 of engine 10 may include one or more intake poppet valves and one or more exhaust poppet valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors 158 and 159. In some examples, an in-cylinder pressure sensor (ICPS) 15 may be used to provide feedback regarding intake and/or exhaust valve positions to the controller 12, as further discussed below. The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing, or fixed cam timing may be used. Each cam actuation system may include one or more cams and may utilize one or more of cam profile switching (CPS), variable cam timing (VCT), variable valve timing (VVT), and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock or in a diesel application where the compression ratio can go to ranges of 18:1 or higher.

In some examples, each cylinder of engine 10 may include a spark plug 192 for initiating combustion. Ignition system 190 may provide an ignition spark to cylinder 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines. Diesel engines may have a cold start assist device like a glow plug installed in the combustion chamber to create a hot spot next to the fuel spray plume to aid ignition during cold start an operation.

In some examples, each cylinder of engine 10 may include the in-cylinder pressure sensor (ICPS) 15 for indicating an in-cylinder pressure which may be utilized for determining an intake and/or exhaust valve opening and/or closing timing as a function of crank angle, as discussed below.

For example, using an in-cylinder pressure sensor, actual exhaust valve opening and closing timings may be determined, which may be used to determine an error to desired exhaust valve (EV) timing, for real-time adjustment of EV timing. Further, intake valve opening and closing timing may be determined from output of the ICPS. Thus, the ICPS may be used to determine valve opening and closing times, or crankshaft positions, in place of, or augmenting, exhaust valve opening (EVO) and intake valve opening (IVO) cam position sensors, which may provide cost saving benefits. Further, in some examples, the ICPS may be used to adjust the EVO and IVO position sensors to provide a more accurate EVO and IVO timings using the actual position on the crank shaft. In some other examples, ICPS may be used to monitor EVO and IVO timings separate from the EVO and IVO position sensors for on-board diagnostics (OBD).

Furthermore, if an EVO and/or IVO timing error is determined (e.g., according to indications from ICPS and/or EVO position sensor), the EVO and/or IVO timing may adjusted to compensate for the EVO and IVO timing errors. For example, when used with the EVO position sensor, an offset value can be learned from the ICPS sensor when the EVO event occurs and added to the EVO position sensor. Further, the pressure indications from the ICPS may also be utilized to determine IMEP and PMEP for evaluating a pumping efficiency of the engine 10.

Each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. Fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating engine 10 with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump and a fuel rail. Further, the fuel tank may have a pressure transducer providing a signal to controller 12.

Fuel injector 170 is shown arranged in intake passage 146, rather than in cylinder 14, in a configuration that provides what is known as port fuel injection into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

Herein, operation of the intake valve 150 may be described in greater detail. For example, the intake valve 150 may be moved from a fully open position to a fully closed position, or to any position therebetween. For all conditions being equal (e.g., throttle position, vehicle speed, pressure, etc.), the fully open position allows more air from the intake passage 146 to enter the cylinder 14 than any other position of the intake valve 150. Conversely, the fully closed position may prevent or allow the least amount of air from the intake passage 146 to enter the cylinder 14 than any other position of the intake valve 150. Thus, the positions between the fully open and fully closed position may allow varying amounts of air to flow between the intake passage 146 and the cylinder 14. In one example, moving the intake valve 150 to a more open position allows more air to flow from the intake passage 146 to the cylinder 14 than its initial position.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations, etc. Moreover, depending on the distribution ratio of injected fuel among injectors 170 and 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof, etc. One example of fuels with different heats of vaporization may include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; ambient pressure from ambient pressure sensor 16, in-cylinder pressure from ICPS 15, exhaust back pressure signal (EBP) from EBP sensor 128, turbine speed from a turbine speed sensor (not shown) coupled to turbine shaft 180, and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. Signal from the MAP sensor 124 may be used to determine a compressor outlet pressure and the signal from the ambient pressure sensor 16 may be used to determine a compressor inlet pressure. Further, signals from MAP sensor 124 and EBP sensor 128 may be utilized to determine a delta pressure across the engine 10. Controller 12 may infer an engine temperature based on an engine coolant temperature.

Controller 12 may output engine/vehicle status information to a human/machine interface 7. In one example, human/machine interface 7 may be a touch screen display. In other examples, human/machine interface 7 may be a light or other known human/machine interface.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all the various components described and depicted by FIG. 1 with reference to cylinder 14.

The controller 12 receives signals from the various sensors of FIG. 1 and then may notify the vehicle operator 130 of potential issues and/or employ the various actuators of FIG. 1 to adjust engine operation based on the received signals and instructions stored on a memory of the controller. That is, the non-transitory read-only memory chip 110 may be programmed with non-transitory, computer readable data representing instructions executable by the microprocessor unit 106 for performing the various diagnostic routines.

In some examples, vehicle 5 may be a hybrid vehicle with multiple sources of torque available to one or more vehicle wheels 55. In other examples, vehicle 5 is a conventional vehicle with only an engine, or an electric vehicle with only electric machine(s). In the example shown, vehicle 5 includes engine 10 and an electric machine 52. Electric machine 52 may be a motor or a motor/generator. Crankshaft 140 of engine 10 and electric machine 52 are connected via a transmission 54 to vehicle wheels 55 when one or more clutches 56 are engaged. In the depicted example, a clutch 56 is provided between crankshaft 140 and electric machine 52. Electric machine 52 is directly coupled to transmission 54. Controller 12 may send a signal to an actuator of clutch 56 to engage or disengage the clutch 56, so as to connect or disconnect crankshaft 140 from electric machine 52 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example during a braking operation.

The controller 12 receives signals from the various sensors of FIG. 1 and employs the various actuators of FIG. 1 to adjust engine operation based on the received signals and instructions stored on a memory of the controller. For example, the controller 12 receives signals from at least MAP sensor 124, EBP sensor 128, turbine speed sensor, engine speed sensor 120, ICPS 15, and input device 132 to determine a desired EV timing that is adjusted from a nominal EV timing (determined from a base EV timing map stored in a non-transitory memory of the controller 12) during various engine and turbocharger operating conditions to improve turbocharger response, reduce engine emissions, and adjust engine torque output. Further the controller 12 employs an exhaust valve actuator 154 to adjust one or more of a position, a duration, and a timing of opening and/or closing, based on the received signals and instructions stored in non-transitory memory of the controller 12. For example, adjusting EV timing to a desired EV timing may include controlling the exhaust valve actuator 154 to adjust an exhaust valve opening timing or closing timing. Further, adjusting EVO timing to a desired EVO timing may include controlling the exhaust valve actuator 154 to adjust an exhaust valve opening timing. Intake valve timing may be adjusted similarly.

Thus, the system of FIG. 1 provides for an engine system, comprising: an engine including a cylinder; a pressure sensor positioned in the cylinder; a first valve position sensor to monitor opening and closing of a poppet valve of the cylinder; and a controller including executable instructions stored in non-transitory memory that cause the controller to correct an intake valve opening timing generated from a valve position sensor via an intake valve opening timing generated from a pressure sensor. The system further comprises additional instructions to determine an intake valve opening timing error according to the corrected intake valve opening timing generated from the valve positon sensor. The system further comprises additional instructions to monitor a modeled intake valve opening timing generated from output of a cylinder pressure sensor.

In some examples, the system includes where monitoring the modeled intake valve opening timing generated from output of the cylinder pressure sensor includes comparing the modeled intake valve opening timing to a predetermined range of intake valve opening timings. The system further comprises additional instructions to adjust a target intake valve opening time in response to output of a diagnostic monitor indicating degradation of an intake valve. The system further comprises additional instructions to correct an exhaust valve opening timing generated from an exhaust valve position sensor via an exhaust valve opening timing generated from a pressure sensor. The system further comprises additional instructions to determine an exhaust valve opening timing error according to the corrected exhaust valve opening timing generated from the exhaust valve positon sensor.

Figure 2A:
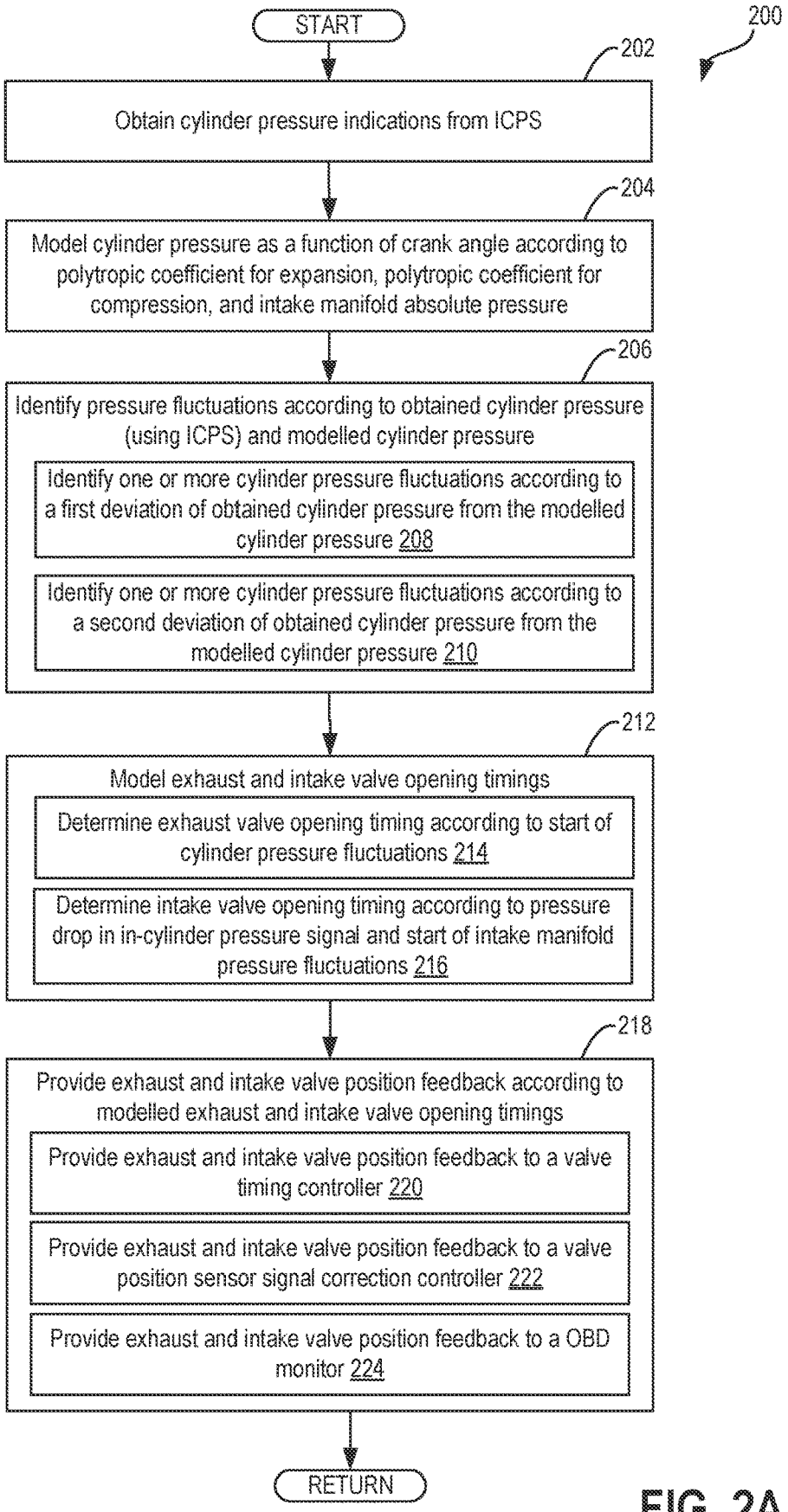
FIG. 2A shows a high level flow chart illustrating a routine that may be implemented to determine cylinder valve timings.
Figure 3A:
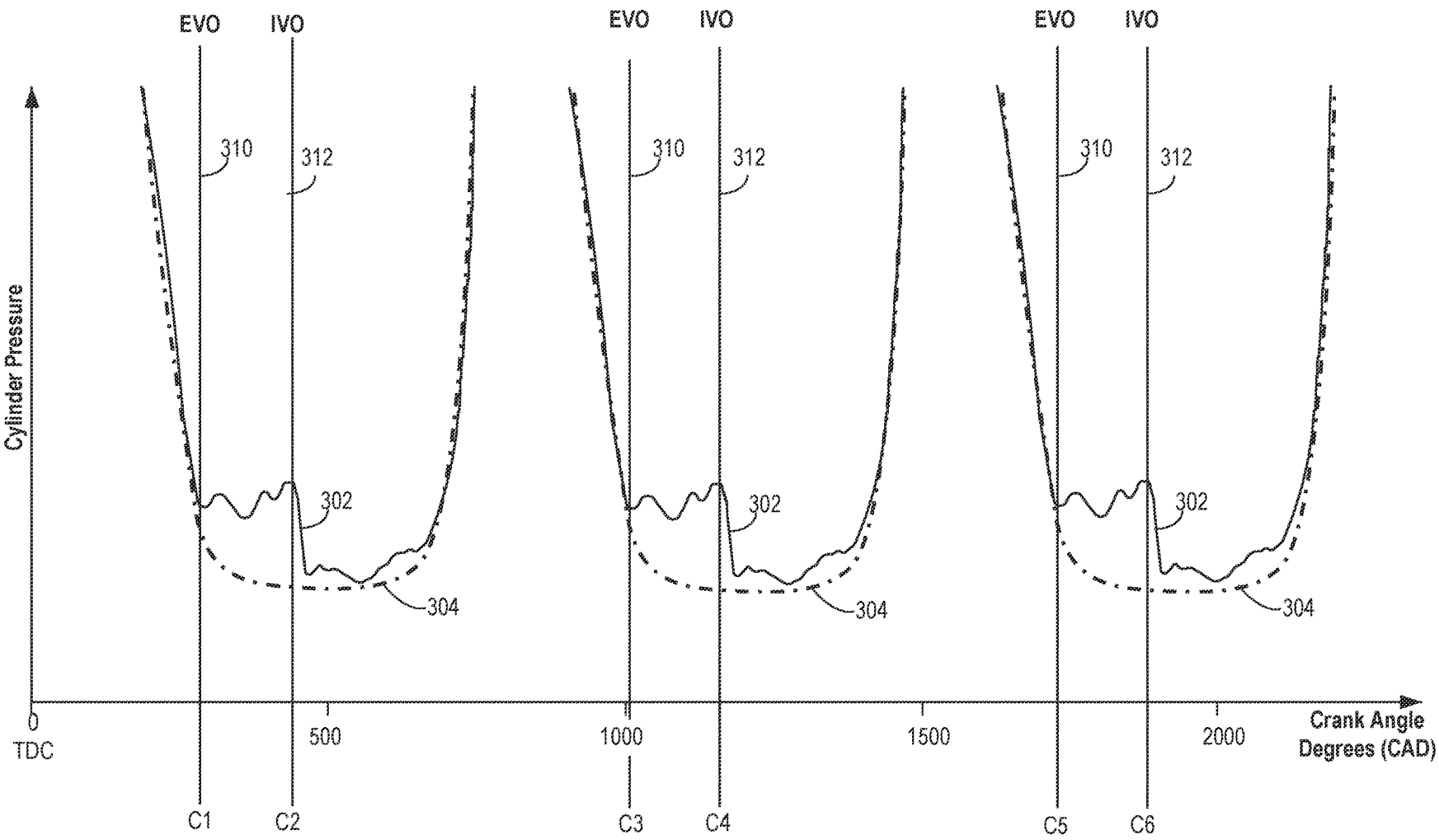
FIG. 3A shows a plot of filtered cylinder pressure data and modeled polytropic expansion and compression versus engine crankshaft angle.
Figure 3B:
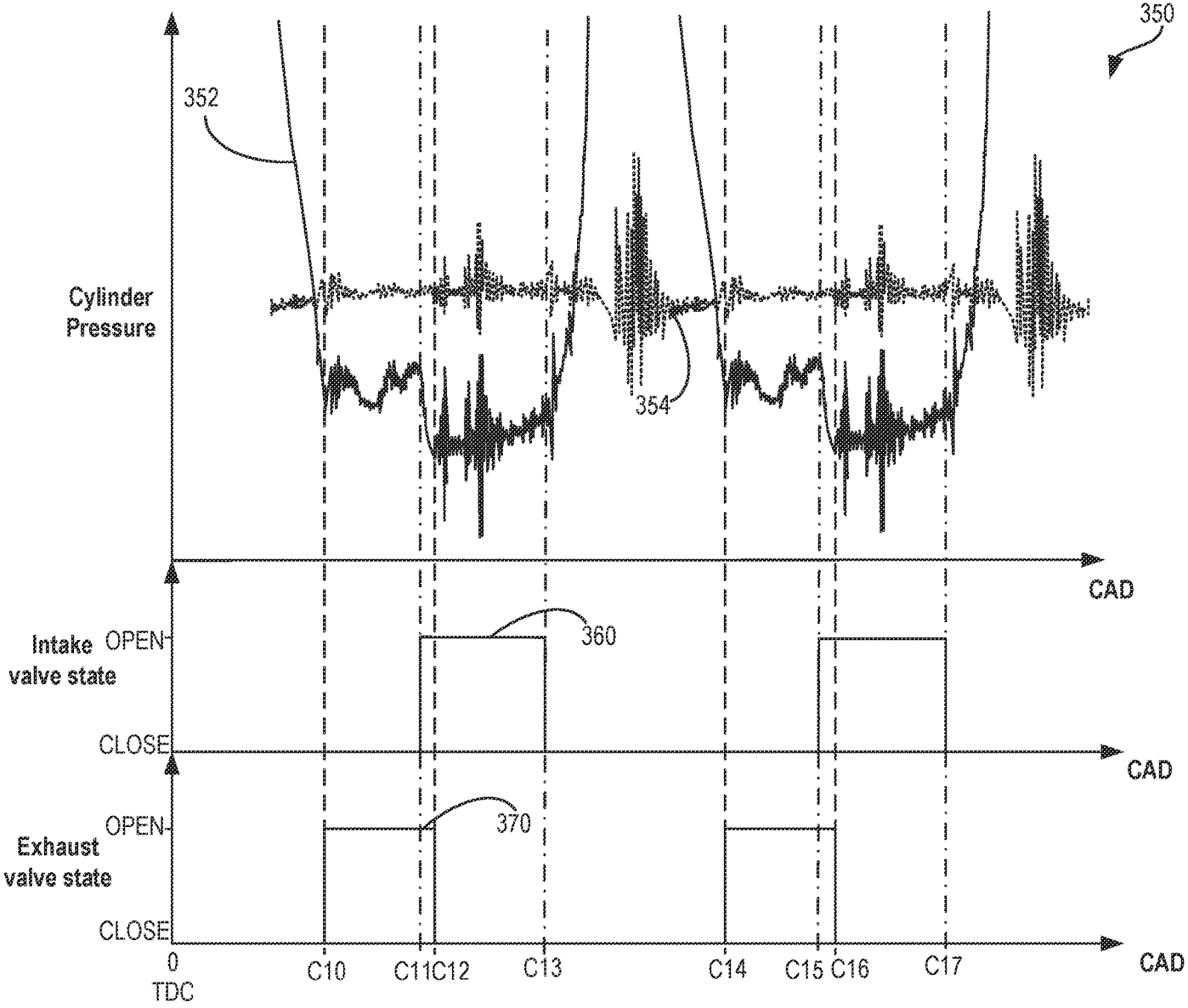
FIG. 3B shows a plot of raw or unfiltered cylinder pressure data and a deviation signal versus engine crankshaft angle.

Turning to FIG. 2A, it shows a flowchart illustrating a high-level method 200 for determining intake and exhaust valve opening timing for an engine cylinder, according to an embodiment of the disclosure. Instructions for carrying out method 200 and the rest of the methods included herein may be executed by a controller, such as controller 12 of FIG. 1, based on instructions stored on a memory of the controller and in conjunction with signals received from sensors of the engine system, such as the sensors described above with reference to FIG. 1. The controller may employ engine actuators of the engine system to adjust engine operation, according to the methods described below.

At 202, the method 200 includes obtaining an actual cylinder pressure indication from a cylinder pressure sensor, such as ICPS 15 at FIG. 1. Along with the actual cylinder pressure, an engine position (e.g., crank angle) from a crankshaft position sensor may be obtained.

Next, at 204, the method 200 includes modelling a closed cylinder in-cylinder pressure using a polytropic expansion coefficient for modelling expansion stroke and a polytropic compression coefficient for modelling compression stroke. The polytropic expansion and compression coefficients may be fixed for a given engine operating condition according to engine speed, load (e.g., idle, medium load, high speed, etc), and engine position. Alternatively, the polytropic and compression coefficients may be variable according to change in engine speed, engine load, and engine position conditions. The polytropic compression and expansion coefficients may be predetermined and indexed to an engine speed and load map, and stored in non-transitory memory. Further, in some examples, an intake manifold absolute pressure indication from a MAP sensor may be used to set a desired reference point (e.g., BDC) in the cylinder cycle. In one example, the polytropic processes may be described by the following equation:

$$pV^{\eta}=C$$

where p is pressure in the cylinder at a particular crankshaft angle, V is volume in the cylinder at the particular crankshaft angle, η, is the coefficient of polytropic compression or expansion (depending on crankshaft position), and C is a constant.

In modelling the in-cylinder pressure, only evolution of cylinder pressure during compression and expansion strokes is modelled, which may enable more accurate identification of intake and exhaust valve opening and closing timing (discussed below) when compared to actual cylinder pressure during a four-stroke cylinder cycle including intake, compression, expansion, and exhaust. Method 200 proceeds to 206.

At 206, method 200 includes identifying fluctuations or changes in the in-cylinder pressure according to output of the ICPS and the cylinder pressure modeled at 204. The fluctuations or changes in cylinder pressure may be indicative of intake and exhaust valve opening and closing positions. Cylinder pressure changes for IVO and EVO may be more significant for IVO and EVO than for intake valve closing (IVC) and exhaust valve closing (EVC) timing.

One or more cylinder pressure fluctuations or changes between the modeled cylinder pressure and the raw cylinder pressure may be indicative of exhaust valve opening timing as discussed with reference to FIG. 3A. In particular, EVO for a specific crankshaft angular interval may be identified at 208 via cylinder pressure increasing or being maintained at a level while polytropic modeled expansion pressure continues to decrease. For example, at crankshaft angle C1 shown in FIG. 3A, polytropic modeled expansion pressure continues to decrease while observed cylinder pressure increases by more than a threshold pressure. Thus, an EVO crankshaft location may be identified as a crankshaft location where polytropic modeled expansion pressure decreases and cylinder pressure increases. Further, EVO may be identified as a crankshaft location where the polytropic modeled expansion pressure and the cylinder pressure begin to separate or diverge by more than a threshold pressure. The cylinder pressure deviates from the polytropic modeled expansion pressure because higher pressure in the exhaust manifold causes pressure in the cylinder to increase as the exhaust valve opens. The higher pressure in the exhaust manifold may be due to exhaust gases of other engine cylinders. Method 200 proceeds to 210 to identify IVO.

One or more cylinder pressure fluctuations or changes between the modeled cylinder pressure and the cylinder pressure may also be indicative of intake valve opening timing as discussed with reference to FIG. 3A. Specifically, IVO for a specific crankshaft angular interval may be identified at 210 via cylinder pressure decreasing while polytropic modeled expansion pressure continues is constant or nearly constant (e.g., changes by less than 5%). For example, at crankshaft angle C2 shown in FIG. 3A, polytropic modeled expansion pressure is nearly constant while observed cylinder pressure decreases by more than a threshold amount of pressure. Thus, an IVO crankshaft location may be identified by a constant polytropic modeled expansion pressure and a decreasing cylinder pressure. Further, IVO may be identified as a crankshaft location where the polytropic modeled expansion pressure and the cylinder pressure begin to converge. The cylinder pressure approaches the polytropic modeled expansion pressure because lower pressure in the intake manifold causes pressure in the cylinder to decrease as the intake valve opens. The lower pressure in the intake manifold may be due to engine cylinders generating a vacuum in the engine intake manifold. Method 200 proceeds to 212.

At 212, method 200 models exhaust and intake valve opening timings or crankshaft locations. The exhaust and intake valve opening locations may be determined in real-time as the engine rotates according to steps 214 and 216.

At 214, exhaust valve opening timings or locations may be identified according to a model at crankshaft locations where cylinder pressure fluctuations begin to increase during a particular crankshaft interval while polytropic modeled expansion cylinder pressure is decreasing. For example, if cylinder pressure is increasing while modeled polytropic modeled expansion cylinder pressure is decreasing and cylinder pressure has increased by more than a threshold pressure during a particular crankshaft angular interval (e.g., ten crankshaft degrees), an EVO model may determine that EVO occurs at the beginning of the particular crankshaft angular interval. Method 200 proceeds to 216.

At 216, intake valve opening timings or locations may be identified according to a model at crankshaft locations where cylinder pressure fluctuations begin to decrease during a particular crankshaft interval while polytropic modeled expansion cylinder pressure is constant or nearly constant. For example, if cylinder pressure is decreasing while modeled polytropic modeled expansion cylinder pressure is constant or nearly constant during a particular crankshaft angular interval (e.g., ten crankshaft degrees), an IVO model may determine that IVO occurs at the beginning of the particular crankshaft angular interval. Method 200 proceeds to 218.

At 218, method 200 provides crankshaft angles or timings where EVO and IVO are determined to occur as determined via the EVO and IVO models to exhaust and intake valve controllers. The controllers may be of the configurations shown in FIGS. 4-6 or similar variants.

Figure 4:
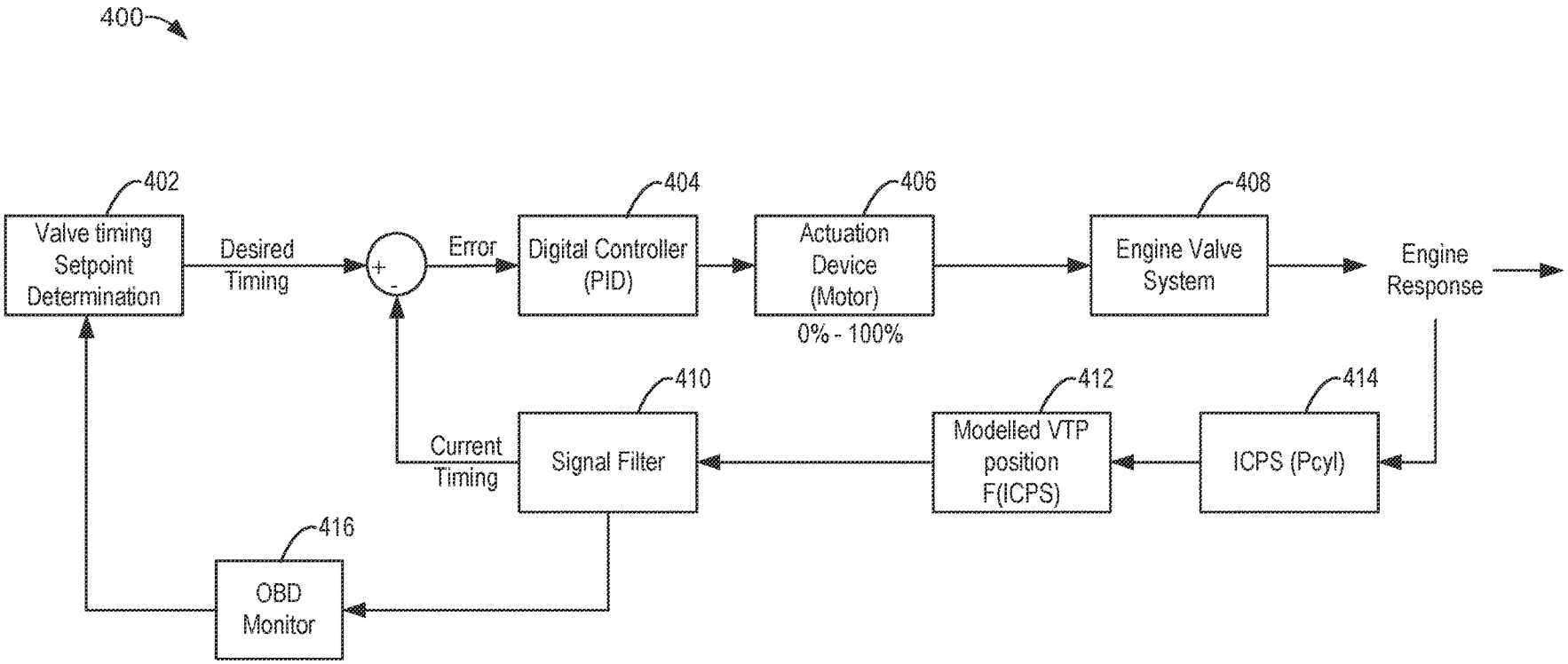
FIG. 4 shows a block diagram of a first controller for operating valves using feedback from cylinder pressure sensors.
Figure 5:
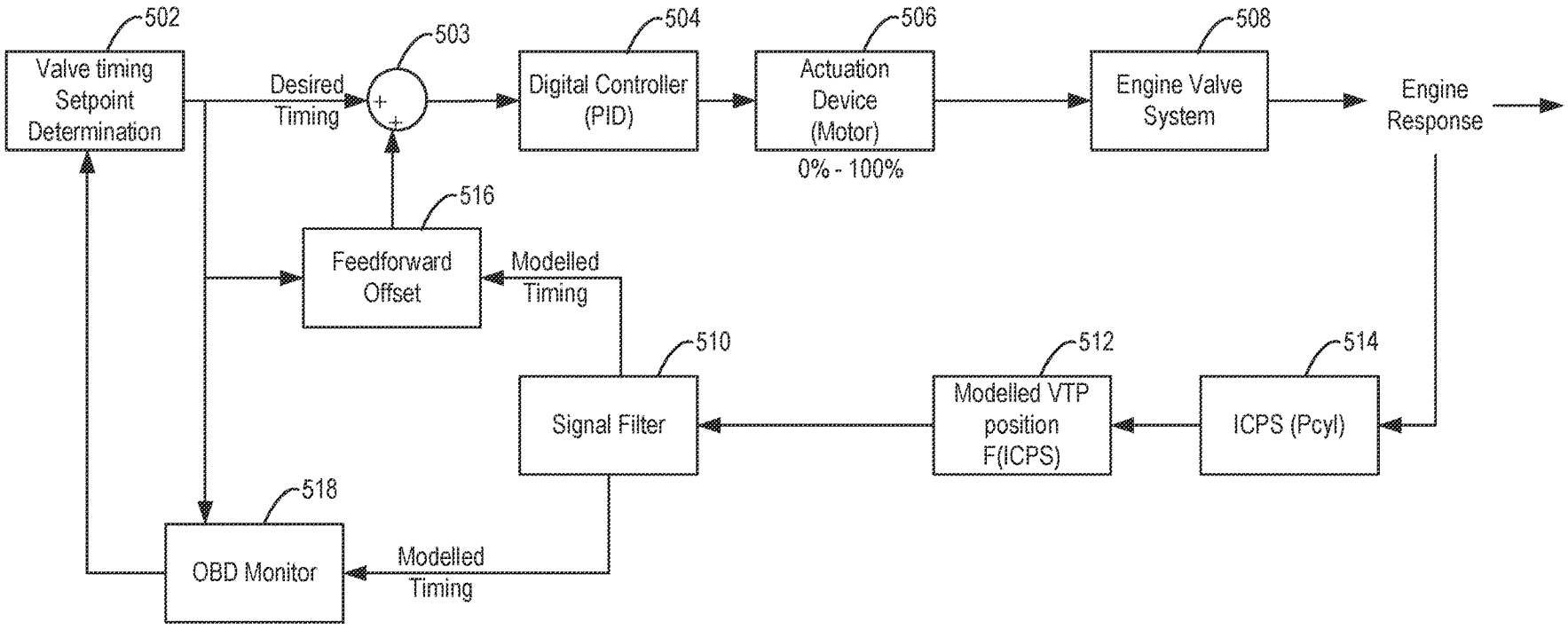
FIG. 5 shows a block diagram of a second controller for operating valves using feedback from cylinder pressure sensors.
Figure 6:
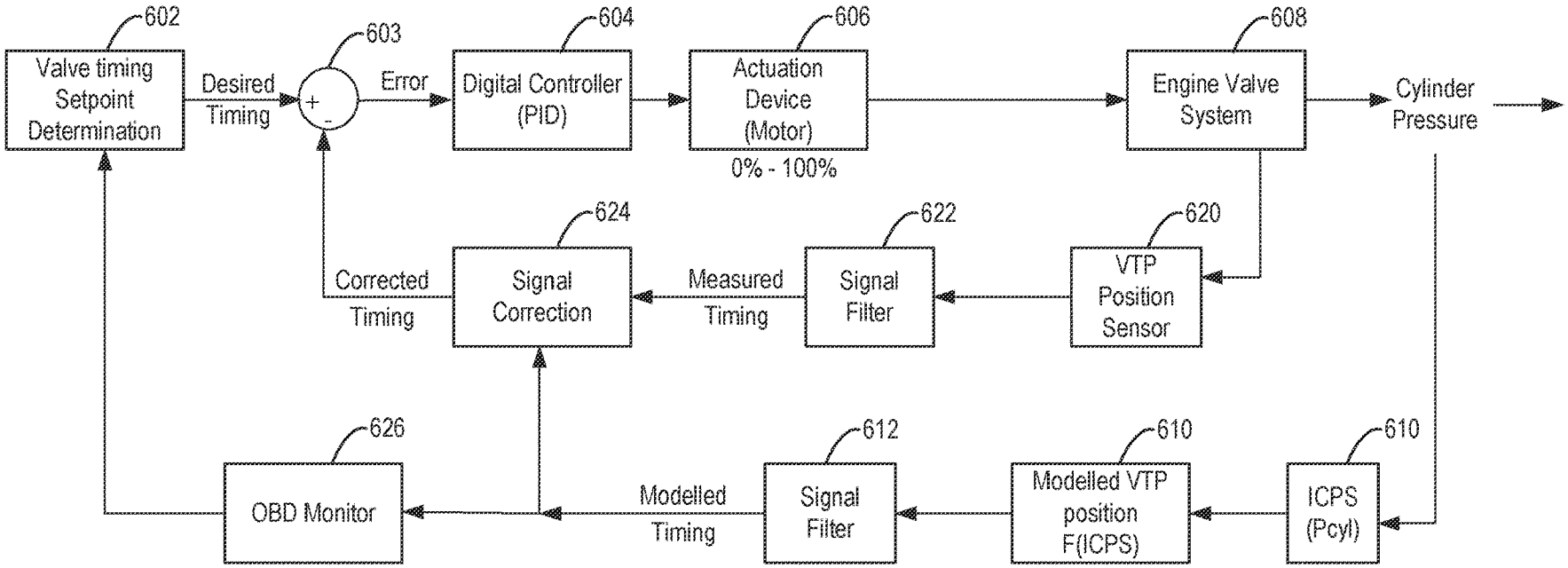
FIG. 6 shows a block diagram of a third controller for operating valves using feedback from cylinder pressure sensors.

At 220, method 200 may provide EVO and IVO timings as feedback to a valve timing controller. The valve timing controller may control intake and exhaust valve opening and closing timings according to EVO and IVO timing errors or in a feedforward arrangement as shown in FIGS. 4-6. Method 200 proceeds to 222.

At 222, method 200 may provide EVO and IVO timings to correct intake and exhaust sensor errors as shown in FIG. 6. The EVO and IVO timings that are determined from cylinder pressure may be applied to correct output of exhaust valve and intake valve position sensors. Method 200 proceeds to 224.

At 224, method 200 provides EVO and IVO timings to an OBD monitor. The OBD monitor may be included in valve controllers as shown in FIGS. 4-6. The OBD monitors may provide an indication as to whether or not EVO and IVO timings are being reliably generated. Method 200 proceeds to exit.

Figure 2B:
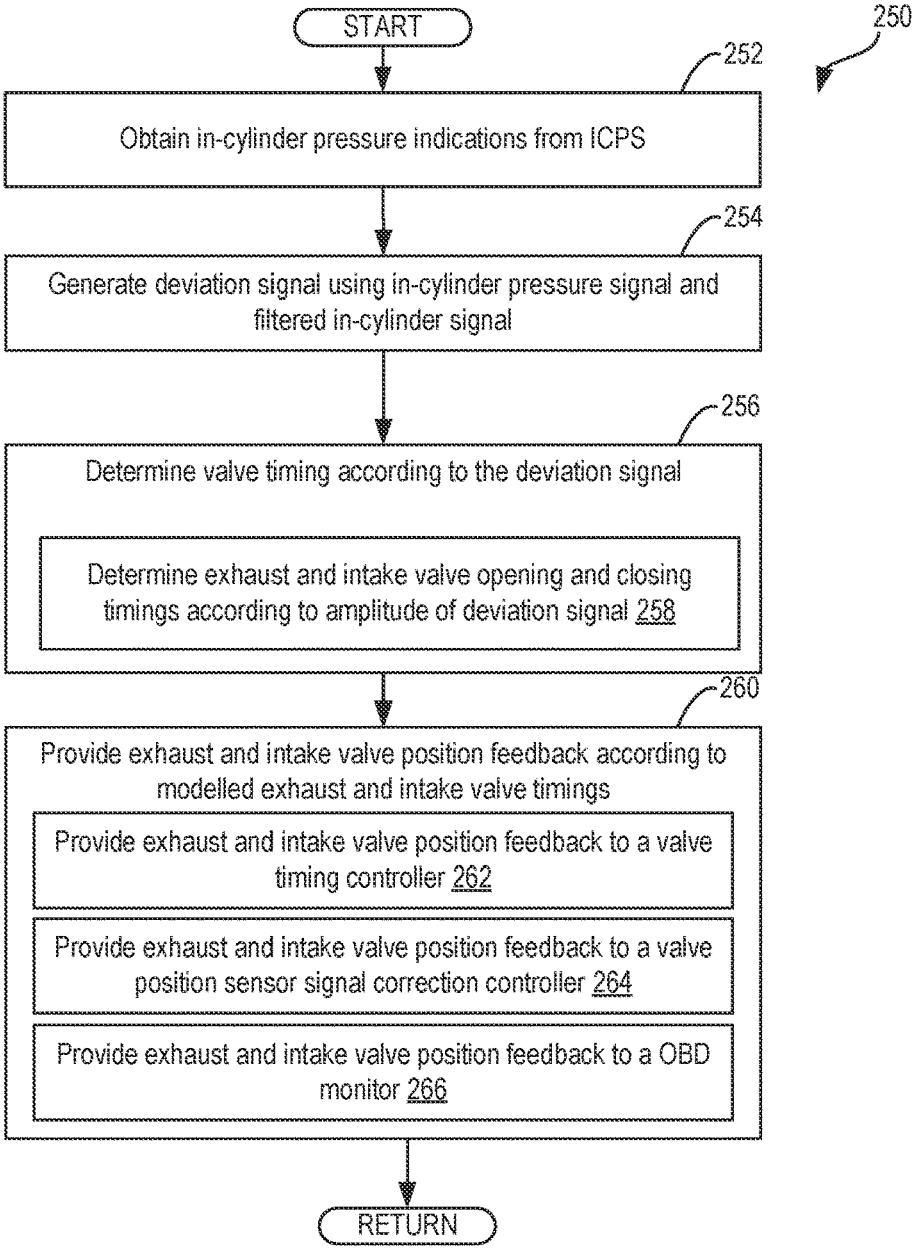
FIG. 2B shows an alternative high level flow chart illustrating a routine that may be implemented to determine cylinder valve timings.

Referring now to FIG. 2B, a flowchart illustrating a high-level method 250 for determining intake and exhaust valve opening timing for an engine cylinder, according to an embodiment of the disclosure. Instructions for carrying out method 250 may be stored on a memory of the controller and in conjunction with signals received from sensors of the engine system, such as the sensors described above with reference to FIG. 1. The controller may employ engine actuators of the engine system to adjust engine operation, according to the methods described below.

At 252, the method 250 includes obtaining an actual cylinder pressure indication from a cylinder pressure sensor, such as ICPS 15 at FIG. 1. Along with the actual cylinder pressure, an engine position (e.g., crank angle) from a crankshaft position sensor may be obtained. Method 250 may also generate a high pass filtered cylinder pressure signal from output of the cylinder pressure sensor (e.g., raw or unfiltered cylinder pressure). In particular, method 200 may apply a high pass filter to the output of a cylinder pressure sensor to generate a filtered pressure for the cylinder.

At 254, the method 250 generates a deviation signal using output of an in-cylinder pressure sensor and the high pass filtered cylinder pressure. In one example, the deviation signal may be generated by subtracting the high pass filtered cylinder pressure from the raw or unfiltered cylinder pressure value that is output of the in-cylinder pressure sensor. Method 250 proceeds to 256.

At 256, method 250 includes determining intake and exhaust valve timing according to the cylinder pressure output from the in-cylinder pressure sensor and the deviation signal. The deviation signal may be indicative of intake and exhaust valve opening and closing times.

At 258, method 250 may determine intake and exhaust opening and closing times according to the amplitude of the deviation signal and crankshaft angle. For example, if the deviation signal amplitude exceeds a threshold value during a predetermined crankshaft interval as shown in FIG. 3B, the crankshaft angle where the deviation signal first exceeds the threshold value during the predetermined crankshaft interval may be determined to be exhaust valve opening time. If the deviation signal amplitude exceeds a threshold value during a second predetermined crankshaft interval, the crankshaft angle where the deviation signal first exceeds a second threshold value during the second predetermined crankshaft interval may be determined to be intake valve opening time. If the deviation signal amplitude exceeds a threshold value during a third predetermined crankshaft interval, the crankshaft angle where the deviation signal first exceeds the third threshold value during the predetermined crankshaft interval may be determined to be exhaust valve closing time. If the deviation signal amplitude exceeds a threshold value during a fourth predetermined crankshaft interval, the crankshaft angle where the deviation signal first exceeds the fourth threshold value during the predetermined crankshaft interval may be determined to be intake valve closing time. Method 250 proceeds to 260.

At 260, method 200 provides crankshaft angles or timings where EVO and IVO are determined to occur to exhaust and intake valve controllers as determined via the deviation signal. The controllers may be of the configurations shown in FIGS. 4-6 or similar variants.

At 262, method 200 may provide EVO and IVO timings as feedback to a valve timing controller. The valve timing controller may control intake and exhaust valve opening and closing timings according to EVO and IVO timing errors or in a feedforward arrangement as shown in FIGS. 4-6. Method 200 proceeds to 264.

At 264, method 200 may provide EVO and IVO timings to correct intake and exhaust sensor errors as shown in FIG. 6. The EVO and IVO timings that are determined from cylinder pressure may be applied to correct output of exhaust valve and intake valve position sensors. Method 200 proceeds to 266.

At 266, method 200 provides EVO and IVO timings to an OBD monitor. The OBD monitor may be included in valve controllers as shown in FIGS. 4-6. The OBD monitors may provide an indication as to whether or not EVO and IVO timings are being reliably generated. Method 200 proceeds to exit.

Methods 200 and 250 may be performed for each engine cylinder. Thus, if the engine includes eight cylinders, method 200 or method 250 may be applied eight times during an engine revolution to determined intake and exhaust valve timings for eight cylinders.

Referring now to FIG. 3A, a plot of filtered cylinder pressure data and modeled polytropic expansion and compression cylinder pressure versus engine crankshaft angle is shown. The plot illustrates a way that intake and exhaust valve opening times may be determined according to filtered cylinder pressure data, modeled polytropic expansion and compression cylinder pressure, and engine crankshaft angle.

The vertical axis represents cylinder pressure and the value of cylinder pressure increases in the direction of the vertical axis arrow. The cylinder pressure is zero at the level of the horizontal axis. The horizontal axis represents engine crankshaft angle and the engine crankshaft angle is expressed in crankshaft degrees. Trace 302 represents a filtered cylinder pressure signal and trace 304 represents modeled polytropic cylinder expansion and compression pressure. Intake valve opening timing is indicated as IVO and exhaust valve opening timing is indicated as EVO. The engine crankshaft angle advances from the left side of the figure to the right side of the figure.

Prior to crankshaft angle C1, the modeled polytropic cylinder expansion and compression pressure is decreasing and the filtered cylinder pressure is decreasing. At crankshaft angle C1, the modeled polytropic cylinder expansion and compression pressure continue decreasing, but the filtered cylinder pressure increases. The diverging pressure differential between modeled polytropic cylinder expansion and compression pressure during a particular crankshaft angular range may be identified by a controller as an indication of EVO at 310. The in cylinder pressure increases because opening the exhaust valve allows higher pressure gases that are in the engine's exhaust manifold to enter the engine cylinder. Between crankshaft angle C1 and C2, the filtered cylinder pressure oscillates while the modeled polytropic cylinder expansion and compression pressure continues decreasing.

At crankshaft angle C2, the modeled polytropic cylinder expansion and compression pressure continue is nearly constant (e.g., is changing by less than ±5%), but the filtered cylinder pressure begins decreasing. The constant or near constant modeled polytropic cylinder expansion and compression pressure and the decreasing filtered cylinder pressure during a particular crankshaft angular range may be identified by a controller as an indication of IVO at 312. The filtered cylinder pressure decrease occurs because opening the intake valve allows gases from the cylinder to flow to a lower pressure region in the engine's intake manifold, thereby reducing pressure in the cylinder. Between crankshaft angle C2 and crankshaft angle C3, the filtered cylinder pressure increases and then decreases. The modeled polytropic cylinder expansion and compression pressure follows the filtered cylinder pressure for a large portion of the crankshaft angular range between crankshaft angle C2 and crankshaft angle C3.

The cylinder cycle repeats such that crankshaft angles C3 and C5 are EVO crankshaft angles in cylinder cycles that follow the cylinder cycle that includes crankshaft angle C1. These EVO events may be determined and indicated by the same modeled polytropic cylinder expansion and compression pressure and filtered cylinder pressure attributes that were used to identify the EVO event at crankshaft angle C1. Crankshaft angles C4 and C6 are IVO crankshaft angles in cylinder cycles that follow the cylinder cycle that includes crankshaft angle C2. These IVO events may be determined and indicated by the same modeled polytropic cylinder expansion and compression pressure and filtered cylinder pressure attributes that were used to identify the IVO event at crankshaft angle C2.

Referring now to FIG. 3B, plots of cylinder pressure, intake valve timing, and exhaust valve timing are shown. The plots illustrate a way that intake and exhaust valve opening times may be determined according to filtered cylinder pressure data, raw pressure data, a deviation signal, and engine crankshaft angle.

The first plot from the top of FIG. 3B is a plot of raw cylinder pressure 352 and a deviation signal 354 versus engine crankshaft angle. The magnitude of the raw cylinder pressure 352 and the magnitude of the deviation signal 354 increase in the direction of the vertical axis arrow. The horizontal axis represents engine crankshaft angle. The engine crankshaft angle advances from the left side of the figure to the right side of the figure.

The second plot from the top of FIG. 3B is a plot of intake valve state versus engine crankshaft angle. The intake valve state is open when trace 360 is at a higher level near the vertical axis. The intake valve state is closed when trace 360 is at a lower level near the horizontal axis. The horizontal axis represents engine crankshaft angle. Trace 360 represents the intake valve state. The engine crankshaft angle advances from the left side of the figure to the right side of the figure.

The third plot from the top of FIG. 3B is a plot of exhaust valve state versus engine crankshaft angle. The exhaust valve state is open when trace 370 is at a higher level near the vertical axis. The exhaust valve state is closed when trace 370 is at a lower level near the horizontal axis. The horizontal axis represents engine crankshaft angle. Trace 370 represents the exhaust valve state. The engine crankshaft angle advances from the left side of the figure to the right side of the figure.

Between TDC (top-dead-center compression stroke) and crankshaft angle C10, the raw cylinder pressure decreases. The deviation signal amplitude changes very little. The deviation signal 354 may be a difference between a filtered cylinder pressure and the raw cylinder pressure. The intake and exhaust valves are closed.

At crankshaft angle C10, the amplitude of the deviation signal increases and the amplitude of the raw cylinder pressure increases. A controller may judge EVO occurs during a particular crankshaft angular range when the magnitude of the deviation signal increases by more than a threshold amount and/or when the magnitude of the raw cylinder pressure increases by more than a threshold amount. The EVO is indicated by trace 370 increasing to a higher level. IVO is not indicated.

At crankshaft angle C11, the amplitude of the raw cylinder pressure decreases. A controller may judge IVO occurs during a particular crankshaft angular range when the magnitude of the raw cylinder pressure signal decreases by more than a threshold amount. The IVO is indicated by trace 360 increasing to a higher level. EVO is still indicated.

At crankshaft angle C12, the amplitude of the deviation signal increases and the amplitude of the raw cylinder pressure increases. A controller may judge exhaust valve closing (EVC) occurs during a particular crankshaft angular range when the magnitude of the deviation signal increases by more than a threshold amount and/or when the magnitude of the raw cylinder pressure increases by more than a threshold amount. The EVC is indicated by trace 370 decreasing to a lower level. IVO is still indicated.

At crankshaft angle C13, the amplitude of the deviation signal increases and the amplitude of the raw cylinder pressure increases. A controller may judge intake valve closing (IVC) occurs during a particular crankshaft angular range when the magnitude of the deviation signal increases by more than a threshold amount and/or when the magnitude of the raw cylinder pressure increases by more than a threshold amount. The IVC is indicated by trace 360 decreasing to a lower level. EVO is not indicated.

A second EVO begins at crankshaft angle C14 and it may be indicated via a controller in response to the deviation signal and/or the raw cylinder pressure signal conditions are similar to those described at crankshaft angle C10. A second IVO begins at crankshaft angle C15 and it may be indicated via a controller in response to the deviation signal and/or the raw cylinder pressure signal conditions are similar to those described at crankshaft angle C11. A second EVC begins at crankshaft angle C16 and it may be indicated via a controller in response to the deviation signal and/or the raw cylinder pressure signal conditions are similar to those described at crankshaft angle C12. A second IVC begins at crankshaft angle C17 and it may be indicated via a controller in response to the deviation signal and/or the raw cylinder pressure signal conditions are similar to those described at crankshaft angle C13.

In this way, EVO, IVO, EVC, and IVC may be determined from attributes of a raw in-cylinder pressure signal or a deviation signal that is based on the raw in-cylinder pressure signal. The EVO, IVO, EVC, and IVC timings may be identified by a controller that monitors the in-cylinder pressure and engine crankshaft position.

Referring now to FIG. 4, a block diagram of a first valve controller is shown. The valve controller shown in FIG. 4 may be applied to control intake and exhaust valves. At least portions of the valve controller shown in FIG. 4 may be implemented as executable instructions stored in non-transitory memory of a controller. The controller of FIG. 4 may be incorporated into and may cooperate with the system shown in FIG. 1 to operate intake and/or exhaust valves. The controller of FIG. 4 may include portions to adjust actuators in the physical world so as to adjust operation of an engine. The controller of FIG. 4 may adjust opening and closing timings of intake and exhaust valves.

At 402, controller 400 determines poppet valve timing (e.g., a target intake/exhaust valve timing). The poppet valve timing may be for intake and/or exhaust valves. In one example, poppet valve timing is determined via referencing one or more tables and/or functions that output values for intake/exhaust valve opening timing and intake/exhaust valve closing timing. The tables and/or functions may be referenced via engine speed and a driver demand torque or power. The driver demand torque or power may be determined from input via a propulsive effort pedal. Block 402 outputs intake/exhaust valve opening and closing timings to summing junction 403.

At summing junction 403, the output of filter block 410 is subtracted from intake/exhaust opening timing and/or closing timing output from block 402. Thus, the output of summing junction 403 is a valve opening/closing timing error value. The error value is input to a digital proportional/integral/derivative (PID) controller at block 404. The error value may be multiplied by proportional, integral, and derivative gains within the PID controller. The output of the PID controller is an intake/exhaust valve opening/closing timing adjustment. The output of the PID controller is input to a valve actuation device (e.g., a motor) at block 406. The valve actuation device causes an intake/exhaust valve to open and close in the valve system represented via block 408. Operating the valves causes the engine to respond, which may affect in-cylinder pressure as shown in FIGS. 3A and 3B. Pressure in an engine cylinder is determined via an in-cylinder pressure sensor represented via block 414.

Cylinder pressure is input to a valve timing position model at block 412. The valve timing position model may determine intake/exhaust valve opening/closing timing as discussed with regard to FIGS. 3A and 3B via one or more of signal characteristics of a raw cylinder pressure signal, a filtered cylinder pressure signal, a deviation signal, crankshaft position, and modeled polytropic cylinder expansion and compression pressure. Block 412 outputs the intake/exhaust valve opening/closing timing to block 410.

At block 410, the intake/exhaust valve opening/closing timings may be optionally filtered to reduce the possibility of unintended intake/exhaust valve opening/closing events. The filtered intake/exhaust valve timings are output to summing junction 403 and on-board diagnostic (OBD) monitor 416.

At block 416, diagnostics are provided to determine whether or not intake/exhaust valve timings are being determined as may be expected. In one example, a crankshaft angle at which intake/exhaust opening/closing timing is determined is compared to a particular crankshaft angular range where intake/exhaust opening/closing timing may be expected. If the output of block 410 falls within this range, block 416 may request valve timings that are based on engine speed and driver demand torque or power from block 402. If the output of block 410 is out of range, block 416 may request alternative valve timings from block 402 and indicate degradation of valve timing detection and/or valves. In one example, the alternative valve timings may be baseline valve timings that are not a function of engine speed and driver demand torque or power.

In another example, a crankshaft angle at which intake/exhaust opening/closing timing is determined is compared to a commanded intake/exhaust opening/closing timing. If the output of block 410 falls is not within a predetermined crankshaft angular distance of the commanded intake/exhaust opening/closing timing. If the intake/exhaust opening/closing timing is within the predetermined crankshaft angular distance, block 416 may request valve timings that are based on engine speed and driver demand torque or power from block 402. If the output of block 410 is not within the predetermined crankshaft angular distance, block 416 may request alternative valve timings from block 402 and indicate degradation of valve timing detection and/or valves. In one example, the alternative valve timings may be baseline valve timings that are not a function of engine speed and driver demand torque or power. Degraded valve operation and/or a degraded valve timing apparatus may be indicated via a human/machine interface.

Thus, the controller of FIG. 4 provides for OBD monitoring and PID control of poppet valve timing. The controller of FIG. 4 operates in response to valve opening/closing feedback that is determined from cylinder pressure.

Referring now to FIG. 5, a block diagram of a second valve controller is shown. The valve controller shown in FIG. 5 may be applied to control intake and exhaust valves. At least portions of the valve controller shown in FIG. 5 may be implemented as executable instructions stored in non-transitory memory of a controller. The controller of FIG. 5 may be incorporated into and may cooperate with the system shown in FIG. 1 to operate intake and/or exhaust valves. The controller of FIG. 5 may include portions to adjust actuators in the physical world so as to adjust operation of an engine. The controller of FIG. 5 may adjust opening and closing timings of intake and exhaust valves.

At 502, controller 500 determines a feedforward poppet valve timing (e.g., a target intake/exhaust valve timing). The poppet valve timing may be for intake and/or exhaust valves. In one example, poppet valve timing is determined via referencing one or more tables and/or functions that output values for intake/exhaust valve opening timing and intake/exhaust valve closing timing. The tables and/or functions may be referenced via engine speed and a driver demand torque or power. The driver demand torque or power may be determined from input via a propulsive effort pedal. Block 502 outputs intake/exhaust valve opening and closing timings to summing junction 403.

At summing junction 503, the output of feedforward offset block 516 is added to intake/exhaust opening timing and/or closing timing output from block 502. Thus, the output of summing junction is an adjusted feedforward valve opening/closing timing. The adjusted feedforward intake/exhaust valve opening/closing timing includes an offset. The feedforward value is input to a digital proportional/integral/derivative (PID) controller at block 504. The feedforward intake/exhaust valve opening/closing time may be multiplied by proportional, integral, and derivative gains within the PID controller. The output of the PID controller is an intake/exhaust valve opening/closing timing adjustment. The output of the PID controller is input to a valve actuation device (e.g., a motor) at block 506. The valve actuation device causes an intake/exhaust valve to open and close in the valve system represented via block 508 in response to output of the PID controller. Operating the valves causes the engine to respond, which may affect in-cylinder pressure as shown in FIGS. 3A and 3B. Pressure in an engine cylinder is determined via an in-cylinder pressure sensor represented via block 514.

Cylinder pressure is input to a valve timing position model at block 512. The valve timing position model may determine intake/exhaust valve opening/closing timing as discussed with regard to FIGS. 3A and 3B via one or more of signal characteristics of a raw cylinder pressure signal, a filtered cylinder pressure signal, a deviation signal, crankshaft position, and modeled polytropic cylinder expansion and compression pressure. Block 512 outputs the intake/exhaust valve opening/closing timing to block 510.

At block 510, the intake/exhaust valve opening/closing timings may be optionally filtered to reduce the possibility of unintended intake/exhaust valve opening/closing events.

The filtered intake/exhaust valve timings are output to feedforward offset block 516 and on-board diagnostic (OBD) monitor 518.

At block 518, diagnostics are provided to determine whether or not intake/exhaust valve timings are being determined as may be expected. In one example, a crankshaft angle at which intake/exhaust opening/closing timing is determined is compared to a particular crankshaft angular range where intake/exhaust opening/closing timing may be expected. If the output of block 510 falls within this range, block 518 may request valve timings that are based on engine speed and driver demand torque or power from block 502. If the output of block 510 is out of range, block 518 may request alternative valve timings from block 502 and indicate degradation of valve timing detection and/or valves. In one example, the alternative valve timings may be baseline valve timings that are not a function of engine speed and driver demand torque or power.

In another example, a crankshaft angle at which intake/exhaust opening/closing timing is determined is compared to a commanded intake/exhaust opening/closing timing. If the output of block 510 falls is not within a predetermined crankshaft angular distance of the commanded intake/exhaust opening/closing timing. If the intake/exhaust opening/closing timing is within the predetermined crankshaft angular distance, block 518 may request valve timings that are based on engine speed and driver demand torque or power from block 502. If the output of block 510 is not within the predetermined crankshaft angular distance, block 518 may request alternative valve timings from block 502 and indicate degradation of valve timing detection and/or valves. In one example, the alternative valve timings may be baseline valve timings that are not a function of engine speed and driver demand torque or power. Degraded valve operation and/or a degraded valve timing apparatus may be indicated via a human/machine interface.

At block 516, the feedforward offset determined intake/exhaust valve opening/closing timing may be based on a difference between the output of block 502 and the output of block 510. Alternatively, the output of block 510 may be used to reference a table or function. The table or function may output an offset value (e.g., 1 crankshaft degree) that is input to summing junction 503.

Thus, the controller of FIG. 5 provides for OBD monitoring and PID control of poppet valve timing. The controller of FIG. 5 operates in response to valve opening/closing feedback that is determined from cylinder pressure. In addition, the controller of FIG. 5 adjusts a feedforward command to control intake/exhaust valve timing.

Referring now to FIG. 6, a block diagram of a third valve controller is shown. The valve controller shown in FIG. 6 may be applied to control intake and exhaust valves. At least portions of the valve controller shown in FIG. 6 may be implemented as executable instructions stored in non-transitory memory of a controller. The controller of FIG. 6 may be incorporated into and may cooperate with the system shown in FIG. 1 to operate intake and/or exhaust valves. The controller of FIG. 6 may include portions to adjust actuators in the physical world so as to adjust operation of an engine. The controller of FIG. 6 may adjust opening and closing timings of intake and exhaust valves.

At 602, controller 600 determines poppet valve timing (e.g., a target intake/exhaust valve timing). The poppet valve timing may be for intake and/or exhaust valves. In one example, poppet valve timing is determined via referencing one or more tables and/or functions that output values for intake/exhaust valve opening timing and intake/exhaust valve closing timing. The tables and/or functions may be referenced via engine speed and a driver demand torque or power. The driver demand torque or power may be determined from input via a propulsive effort pedal. Block 602 outputs intake/exhaust valve opening and closing timings to summing junction 603.

At summing junction 603, the output of signal correction block 624 is subtracted from intake/exhaust opening timing and/or closing timing output from block 602. Thus, the output of summing junction 603 is a valve opening/closing timing error value. The error value is input to a digital proportional/integral/derivative (PID) controller at block 604. The error value may be multiplied by proportional, integral, and derivative gains within the PID controller. The output of the PID controller is an intake/exhaust valve opening/closing timing adjustment. The output of the PID controller is input to a valve actuation device (e.g., a motor) at block 606. The valve actuation device causes an intake/exhaust valve to open and close in the valve system represented via block 608. Position of intake/exhaust valves may be determined via valve position sensors (e.g., 158 and 159 of FIG. 1) shown as block 620. The output of the valve position sensor may be filtered at block 622. Operating the valves causes the engine to respond, which may affect in-cylinder pressure as shown in FIGS. 3A and 3B. Pressure in an engine cylinder is determined via an in-cylinder pressure sensor represented via block 610.

Cylinder pressure is input to a valve timing position model at block 610. The valve timing position model may determine intake/exhaust valve opening/closing timing as discussed with regard to FIGS. 3A and 3B via one or more of signal characteristics of a raw cylinder pressure signal, a filtered cylinder pressure signal, a deviation signal, crankshaft position, and modeled polytropic cylinder expansion and compression pressure. Block 610 outputs the intake/exhaust valve opening/closing timing to block 612.

At block 612, the intake/exhaust valve opening/closing timings may be optionally filtered to reduce the possibility of unintended intake/exhaust valve opening/closing events. The filtered intake/exhaust valve timings are output to signal correction block 624 and on-board diagnostic (OBD) monitor 626.

At block 626, diagnostics are provided to determine whether or not intake/exhaust valve timings are being determined as may be expected. In one example, a crankshaft angle at which intake/exhaust opening/closing timing is determined is compared to a particular crankshaft angular range where intake/exhaust opening/closing timing may be expected. If the output of block 612 falls within this range, block 626 may request valve timings that are based on engine speed and driver demand torque or power from block 602. If the output of block 612 is out of range, block 626 may request alternative valve timings from block 602 and indicate degradation of valve timing detection and/or valves. In one example, the alternative valve timings may be baseline valve timings that are not a function of engine speed and driver demand torque or power.

In another example, a crankshaft angle at which intake/exhaust opening/closing timing is determined is compared to a commanded intake/exhaust opening/closing timing. If the output of block 612 falls is not within a predetermined crankshaft angular distance of the commanded intake/exhaust opening/closing timing. If the intake/exhaust opening/closing timing is within the predetermined crankshaft angular distance, block 626 may request valve timings that are based on engine speed and driver demand torque or power from block 602. If the output of block 612 is not within the predetermined crankshaft angular distance, block 626 may request alternative valve timings from block 602 and indicate degradation of valve timing detection and/or valves. In one example, the alternative valve timings may be baseline valve timings that are not a function of engine speed and driver demand torque or power. Degraded valve operation and/or a degraded valve timing apparatus may be indicated via a human/machine interface.

At signal correction block 624, the output of block 612 may be subtracted from the output of block 622 to generate a corrected valve timing. For example, of the output of block 622 is 20 crankshaft degrees before bottom-dead-center intake stroke and the output of block 612 is 15 crankshaft degrees before bottom-dead-center intake stroke, the output of signal correction block 624 may be 5 crankshaft degrees. The output of block 624 is input to summing junction 603.

Thus, the controller of FIG. 6 provides for OBD monitoring and PID control of poppet valve timing. The controller of FIG. 6 operates in response to valve opening/closing feedback that is determined from cylinder pressure. In addition, the controller of FIG. 6 corrects valve timing as determined from a mechanical sensor via valve timing as determined from a pressure sensor.

Thus, the controllers of FIGS. 4-6 provide for a method for operating an engine, comprising: via a controller, estimating intake valve opening timing and estimating exhaust valve opening timing of a cylinder from output of a pressure sensor in the cylinder; adjusting a feedforward intake valve opening timing via a feedforward intake valve offset without generating an error value, the feedforward intake valve offset based on the estimated intake valve opening timing; and adjusting opening of an intake valve according to the adjusted feedforward intake valve opening timing. The method further comprises adjusting a feedforward exhaust valve opening timing via a feedforward exhaust valve offset without generating a feedforward intake valve opening timing error, the feedforward exhaust valve offset based on the estimate exhaust valve opening timing.

In some examples, the method further comprises adjusting opening of an exhaust valve according to the adjusted feedforward exhaust valve opening timing. The method further comprises adjusting the feedforward exhaust valve opening timing in response to a state of an exhaust valve opening timing monitor, the exhaust valve opening timing monitor responsive to exhaust valve opening timing that is based on pressure in the cylinder. The method includes where adjusting the feedforward exhaust valve opening timing includes adjusting the feedforward exhaust valve opening timing to a baseline timing. The method further comprises adjusting the feedforward intake valve opening timing in response to a state of an intake valve opening timing monitor, the intake valve opening timing monitor responsive to intake valve opening timing that is based on pressure in the cylinder. The method includes where adjusting the feedforward intake valve opening timing includes adjusting the feedforward intake valve opening timing to baseline timing.

The controllers of FIGS. 4-6 provide for a method for operating an engine, comprising: via a controller, estimating intake valve opening timing and estimating exhaust valve opening timing of a cylinder from output of a pressure sensor in the cylinder; generating an intake valve timing error via subtracting the estimated intake valve opening timing from a target intake valve opening timing; generating an exhaust valve timing error via subtracting the estimated exhaust valve opening timing from a target exhaust valve opening timing; and adjusting the target intake valve opening timing in response to a state of an intake valve opening timing monitor. The method further comprises adjusting the target exhaust valve opening timing in response to a state of an exhaust valve opening timing monitor. The method includes where the intake valve opening timing monitor indicates intake valve degradation in response to an absence of an estimated intake valve opening during a cycle of the cylinder as determined from output of the pressure sensor. The method includes where the intake valve opening timing monitor indicates intake valve degradation in response to an estimated intake valve opening during a cycle of the cylinder as determined from output of the pressure sensor being outside of a predetermined crankshaft angular range. The method includes where the exhaust valve opening timing monitor indicates exhaust valve degradation in response to an absence of an estimated exhaust valve opening during a cycle of the cylinder as determined from output of the pressure sensor. The method includes where the exhaust valve opening timing monitor indicates exhaust valve degradation in response to an estimated exhaust valve opening during a cycle of the cylinder as determined from output of the pressure sensor being outside of a predetermined crankshaft angular range.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for operating an engine, comprising:

via a controller, estimating intake valve opening timing and estimating exhaust valve opening timing of a cylinder from an output of a pressure sensor in the cylinder, where estimating intake valve opening timing and estimating exhaust valve opening timing includes generating a polytropic cylinder pressure via a polytropic cylinder pressure model and comparing the polytropic cylinder pressure to the output of the pressure sensor;

adjusting a feedforward intake valve opening timing via a feedforward intake valve offset, the feedforward intake valve offset based on the estimated intake valve opening timing; and adjusting opening of an intake valve according to the adjusted feedforward intake valve opening timing.

2. The method of claim 1, further comprising:

determining an intake valve opening crankshaft position based on a decrease in the output of the pressure sensor and a nearly constant value of the polytropic cylinder pressure; and adjusting a feedforward exhaust valve opening timing via a feedforward exhaust valve offset, the feedforward exhaust valve offset based on the estimated exhaust valve opening timing.

3. The method of claim 2, further comprising adjusting opening of an exhaust valve according to the adjusted feedforward exhaust valve opening timing.

4. The method of claim 3, further comprising adjusting the feedforward exhaust valve opening timing in response to a state of an exhaust valve opening timing monitor, the exhaust valve opening timing monitor responsive to exhaust valve opening timing that is based on pressure in the cylinder.

5. The method of claim 4, where adjusting the feedforward exhaust valve opening timing includes adjusting the feedforward exhaust valve opening timing to a baseline timing.

6. The method of claim 1, further comprising adjusting the feedforward intake valve opening timing in response to a state of an intake valve opening timing monitor, the intake valve opening timing monitor responsive to intake valve opening timing that is based on pressure in the cylinder; and determining an exhaust valve opening crankshaft position based on an increase in the output of the pressure sensor and a decrease in the polytropic cylinder pressure.

7. The method of claim 6, where adjusting the feedforward intake valve opening timing includes adjusting the feedforward intake valve opening timing to a baseline timing.

8. An engine system, comprising:

an engine including a cylinder;

a pressure sensor positioned in the cylinder;

a first valve position sensor to monitor opening and closing of a poppet valve of the cylinder; and a controller including executable instructions stored in non-transitory memory that cause the controller to correct an intake valve opening timing generated from a valve position sensor via an intake valve opening timing generated from a pressure output of a pressure sensor and a polytropic cylinder pressure.

9. The system of claim 8, further comprising:

additional instructions to determine an intake valve opening timing error according to the corrected intake valve opening timing generated from the valve positon sensor, and additional instructions to determine the intake valve opening timing generated from the pressure output of the pressure sensor and the polytropic cylinder pressure based on a crankshaft angle where the polytropic cylinder pressure and the pressure output of the pressure sensor begin to converge.

10. The system of claim 8, further comprising additional instructions to monitor an estimated intake valve opening timing generated from the pressure output of the pressure sensor.

11. The system of claim 10, where monitoring the estimated intake valve opening timing generated from output of the pressure output of the pressure sensor includes comparing the estimated intake valve opening timing to a predetermined range of intake valve opening timings.

12. The system of claim 11, further comprising additional instructions to adjust a target intake valve opening time in response to output of a diagnostic monitor indicating degradation of an intake valve.

13. The system of claim 8, further comprising additional instructions to correct an exhaust valve opening timing generated from an exhaust valve position sensor via an exhaust valve opening timing generated from the polytropic cylinder pressure.

14. The system of claim 8, further comprising additional instructions to determine an exhaust valve opening timing error according to a corrected exhaust valve opening timing generated from the exhaust valve positon sensor.

15. A method for operating an engine, comprising:

via a controller, estimating intake valve opening timing and estimating exhaust valve opening timing of a cylinder from output of a pressure sensor in the cylinder and a polytropic cylinder pressure;

generating an intake valve timing error via subtracting the estimated intake valve opening timing from a target intake valve opening timing;

generating an exhaust valve timing error via subtracting the estimated exhaust valve opening timing from a target exhaust valve opening timing; and adjusting the target intake valve opening timing in response to a state of an intake valve opening timing monitor.

16. The method of claim 15, further comprising adjusting the target exhaust valve opening timing in response to a state of an exhaust valve opening timing monitor, and determining an intake valve opening crankshaft position based on a decrease in the output of the pressure sensor and a nearly constant value of the polytropic cylinder pressure.

17. The method of claim 15, where the intake valve opening timing monitor indicates intake valve degradation in response to an absence of an estimated intake valve opening during a cycle of the cylinder as determined from output of the pressure sensor.

18. The method of claim 15, where the intake valve opening timing monitor indicates intake valve degradation in response to an estimated intake valve opening during a cycle of the cylinder as determined from output of the pressure sensor being outside of a predetermined crankshaft angular range.

19. The method of claim 15, where the exhaust valve opening timing monitor indicates exhaust valve degradation in response to an absence of an estimated exhaust valve opening during a cycle of the cylinder as determined from output of the pressure sensor.

20. The method of claim 15, where the exhaust valve opening timing monitor indicates exhaust valve degradation in response to an estimated exhaust valve opening during a cycle of the cylinder as determined from output of the pressure sensor being outside of a predetermined crankshaft angular range.

* * * * *